US005272028A

United States Patent [19]

Kashizaki et al.

[11] Patent Number: 5,272,028

[45] Date of Patent: Dec. 21, 1993

[54] ELECTROPHOTOGRAPHIC PHOTOSENSITIVE MEMBER COMPRISING A TRIS-AZO PIGMENT

[75] Inventors: Yoshio Kashizaki; Hajime Miyazaki, both of Yokohama; Toshie Miyaji, Kawasaki, all of Japan

[73] Assignee: Canon Kabushiki Kaisha, Tokyo, Japan

[21] Appl. No.: 578,448

[22] Filed: Sep. 7, 1990

[30] Foreign Application Priority Data

Sep. 8, 1989 [JP] Japan ..... 1-231521

[51] Int. Cl.[5] ..... G03G 5/06

[52] U.S. Cl. ..... 430/58; 430/66; 430/73; 355/296; 358/401

[58] Field of Search ..... 430/58, 72, 73, 75, 430/76, 78, 79, 66; 260/152, 164, 165; 355/296; 358/401

[56] References Cited

U.S. PATENT DOCUMENTS 4,426,432 1/1984 Sawada et al. .
4,433,039 9/1986 Takiguchi et al. .
4,760,003 7/1988 Matsumoto et al. .

FOREIGN PATENT DOCUMENTS 1007095 3/1977 Canada .
57-116345 7/1982 Japan .
58-95742 6/1983 Japan .
59-46653 3/1984 Japan .
63-264762 11/1988 Japan .

OTHER PUBLICATIONS

"A. C. Bellaart", Reduction of Oromatic Nitro Compounds With Compounds With Phosphine, Tetrahedron, vol. 21, pp. 3285-3288 (1965).

Organic Chemistry, 3rd Gd. by Hendrickson, et al., published by McGraw-Hill, (1970) p. 1167.

*Primary Examiner*—Marion E. McCamish
*Assistant Examiner*—S. Rosasco
*Attorney, Agent, or Firm*—Fitzpatrick, Cella, Harper & Scinto

[57] ABSTRACT

An electrophotographic photosensitive member has a photosensitive layer provided on an electroconductive support. The photosensitive layer contains an azo pigment represented by the general formula (I):

$$A_1-N=N-Ar_1-\overset{\overset{\displaystyle O}{\uparrow}}{N}=N-Ar_2-N=N-A_2 \quad (1)$$

wherein $Ar_1$ and $Ar_2$ are respectively a divalent aromatic hydrocarbon group or a divalent heterocyclic group which may be the same or different and may have a substituent, and $A_1$ and $A_2$ are respectively a coupler residue having a phenolic hydroxyl group which may be the same or different.

9 Claims, 1 Drawing Sheet

ELECTROPHOTOGRAPHIC PHOTOSENSITIVE MEMBER COMPRISING A TRIS-AZO PIGMENT

BACKGROUND OF THE INVENTION

1. Field of the Invention

The present invention relates to an electrophotographic photosensitive member. More particularly, the present invention relates to an electrophotographic photosensitive member which contains an azo pigment having a specified structure in a photosensitive layer.

2. Related Background Art

Known organic photoconductive substances for electrophotographic photosensitive members include photoconductive polymers represented by poly-N-vinylcarbazoles, and low molecular-weight organic photoconductive substances like 2,5-bis(p-diethylaminophenyl)-1,3,4-oxadiazole, and further, combinations of such an organic photoconductive substance, and a dye or a pigment.

Electrophotographic photosensitive members employing an organic photoconductive substance have the advantages of being provided advantageously at high productivity and at low product price owing to relatively low material cost and a coating production method, and the sensitivity thereof can be arbitrarily controlled. Accordingly, electrophotographic photosensitive members have been investigated comprehensively. Recent development of a function-separation type of photosensitive member, which is constituted of lamination by a charge-generating layer containing an organic photoconductive dye or pigment, and a charge-transporting layer-containing an aforementioned photoconductive polymer or a low-molecular organic photoconductive substance, has achieved remarkable improvement in sensitivity and durability of conventional organic electrophotographic photosensitive members.

Azo pigments have excellent photoconductivity. Various characteristics thereof can readily be obtained by combination of an azo component with a coupler component. Accordingly a number of azo pigments have heretofore been reported. The examples are described in Japanese Patent Laid-open Application Nos. 57-116345, 58-95742, etc. The electrophotographic photosensitive members employing such an azo pigment, however, are not satisfactory in sensitivity and potential stability in repeated use.

SUMMARY OF THE INVENTION

The present invention intends to provide an electrophotographic photosensitive member comprising a photosensitive layer containing a novel photoconductive substance.

The present invention also intends to provide an electrophotographic photosensitive member having high sensitivity characteristics, and stable potential characteristics in repeated use.

The present invention provides an electrophotographic photosensitive member having a photosensitive layer on an electroconductive support, the photosensitive layer containing an azo pigment represented by the general formula (I):

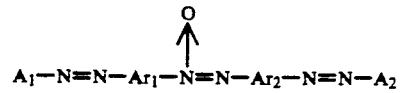

$$A_1-N=N-Ar_1-\overset{\overset{\displaystyle O}{\uparrow}}{N}=N-Ar_2-N=N-A_2 \quad (1)$$

wherein $Ar_1$ and $Ar_2$ are respectively a divalent aromatic hydrocarbon group or a divalent heterocyclic group which may be the same or different and may have a substituent, and $A_1$ and $A_2$ are respectively a coupler residue having a phenolic hydroxyl group which may be the same or different.

DETAILED DESCRIPTION OF THE PREFERRED EMBODIMENT

Figure 1:
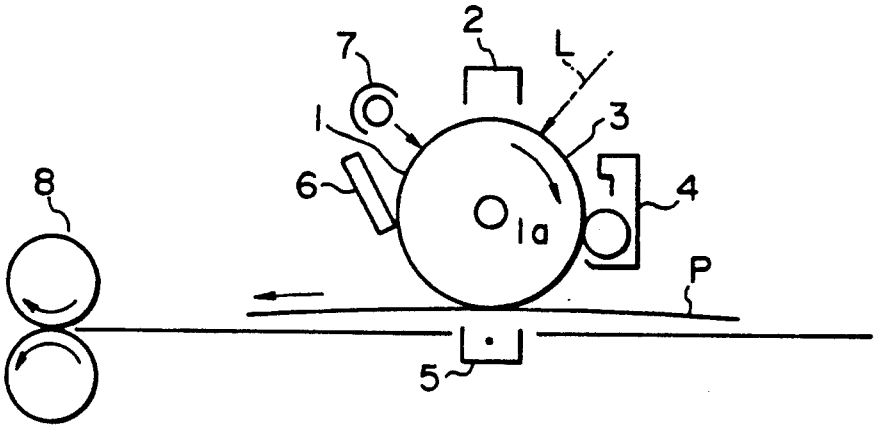
FIG. 1 is a schematic diagram of an example of an electrophotographic apparatus employing an electrophotographic photosensitive member of the present invention.

The present invention relates to an electrophotographic photosensitive member having a photosensitive layer provided on an electroconductive support, the photosensitive layer containing an azo pigment represented by the general formula (I):

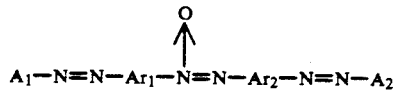

$$A_1-N=N-Ar_1-\overset{\overset{\displaystyle O}{\uparrow}}{N}=N-Ar_2-N=N-A_2 \quad (1)$$

wherein $Ar_1$ and $Ar_2$ are respectively a divalent aromatic hydrocarbon group or a divalent heterocyclic group which may be the same or different and may have a substituent, and $A_1$ and $A_2$ are respectively a coupler residue having a phenolic hydroxyl group which may be the same or different.

Preferable examples of $Ar_1$ and $Ar_2$ in the general formula (1) are o-phenylene, m-phenylene, p-phenylene, 1,4-naphthylene, 1,5-naphthylene, 2,3-naphthylene, 2,3-pyridinediyl, 2,4-pyridinediyl, 2,5-pyridinediyl, and the like.

The substituent which may be introduced into the aromatic hydrocarbon group or the heterocyclic group includes alkyl groups such as methyl, ethyl, propyl, butyl, and the like; alkoxy groups such as methoxy, ethoxy, propoxy, butoxy, and the like; halogen atoms such as fluorine, chlorine, bromine, and the like; a hydroxy group; a cyano group; halomethyl groups such as trifluoromethyl and the like, and so on.

Specific examples of $A_1$ and $A_2$ in the general formula (1) are a coupler residue as shown by the general formula (2) to (6). General formula:

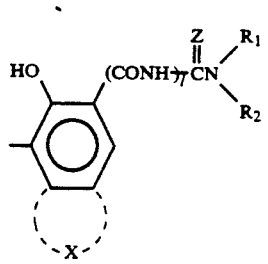

(2)

-continued (3)

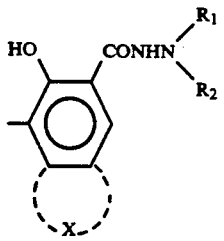

(4)

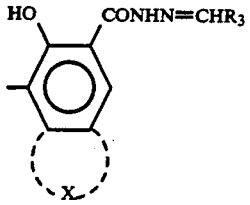

(5)

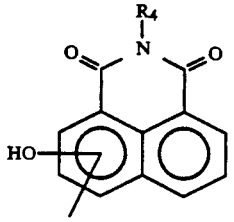

(6)

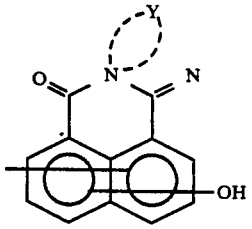

In the general formulas (2), (3), and (4), X represents a residual group required for forming a polycyclic aromatic or heterocyclic ring such as a naphthalene ring, an anthracene ring, a carbazole ring, a benzocarbazole ring, a benzofuran ring, and the like by condensing a benzene ring, which may have a substituent.

In the general formula (6), Y represents a bivalent aromatic hydrocarbon group or a bivalent heterocyclic ring group containing a nitrogen atom in the ring, which may have a substituent. The specific examples are o-phenylene, o-naphtylene, perinaphthylene, 1,2-anthrylene, 3,4-pyrazolediyl, 2,3-pyridinediyl, 4,5-pyridinediyl, 6,7-indazolediyl, 6,7-quinolinedily, and the like.

In the general formula (2), and (3), $R_1$ and $R_2$ are a hydrogen atom; or an alkyl, aryl, aralkyl, or heterocyclic group which may have a substituent. Further $R_1$ and $R_2$ may form a cyclic amino group through a nitrogen atom.

In the general formula (4), $R_3$ is a hydrogen atom, or an alkyl, aryl, aralkyl, or heterocyclic group which may have a substituent.

In the general formula (5), $R_4$ is an alkyl, aryl, aralkyl, or heterocyclic group which may have a substituent.

The above described alkyl group includes methyl, ethyl, propyl, and the like; the aralkyl group includes benzyl, phenethyl, and the like; the aryl group includes phenyl, naphtyl, anthryl, and the like; the heterocyclic group includes pyridyl, thienyl, thiazolyl, carbazolyl, benzoimidazolyl, benzothiazolyl, and the like; and the cyclic amino group having a nitrogen atom in the ring includes pyrrole, pyrroline, pyrrolidine, pyrrolidone, indole, indoline, carbazole, imidazole, pyrazole, pyrazoline, oxazine, phenoxazine, and the like.

The aforementioned substituent includes alkyl groups such as methyl, ethyl, propyl, butyl, and the like; alkoxy groups such as methoxy, ethoxy, propoxy, and the like; halogen atoms such as fluorine, chlorine, bromine, and the like; dialkylamino groups such as dimethylamino, diethylamino, and the like; a phenylcarbamoyl group, a nitro group, a cyano group; halomethyl groups such as trifluoromethyl; and so on.

In the general formula (2), Z is an oxygen atom or a sulfur atom, and l is 0 or 1.

The pigments of the general formula (1), in which $A_1$ and $A_2$ are groups represented by the general formula (2), (3), or (4), and X is a coupler residue forming a benzocarbazole ring by condensation with a benzene ring, have a broad absorption band extending to near infrared region, and are suitable also for a charge-generating material for semiconductor lasers.

Typical examples of azo pigments of the general formula (1) are shown below. The present invention is not limited by these examples.

General formula (1)

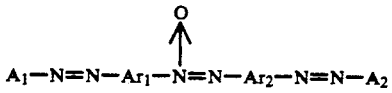

(1)

Exemplified pigment (1)

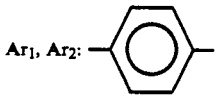

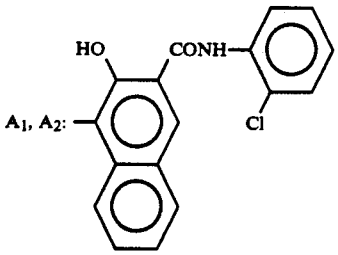

Exemplified pigment (2)

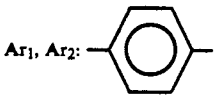

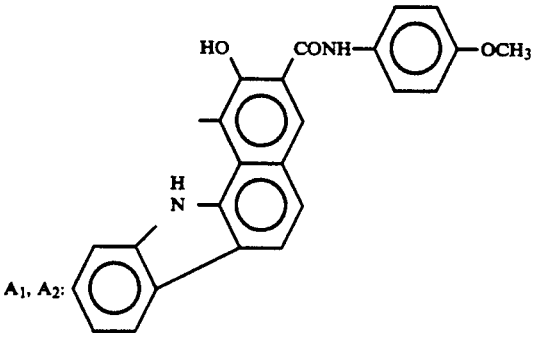

-continued
General formula (1)
Exemplified pigment (3)
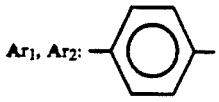
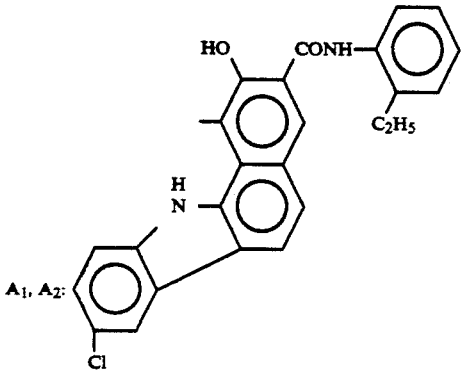
Exemplified pigment (4)
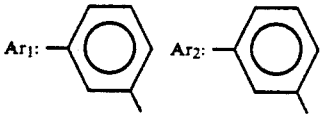
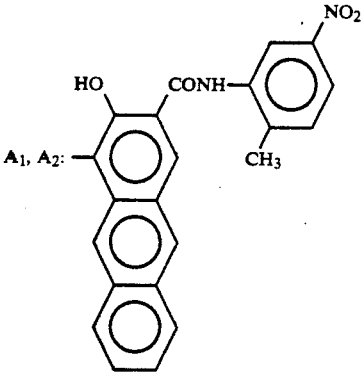
Exemplified pigment (5)
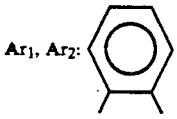
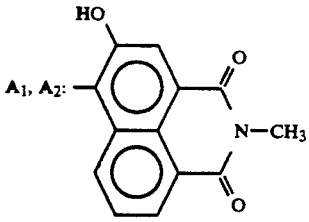
Exemplified pigment (6)
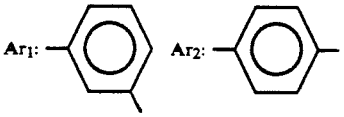
-continued
General formula (1)
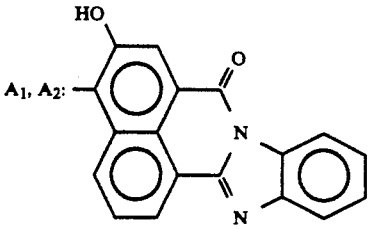
Exemplified pigment (7)
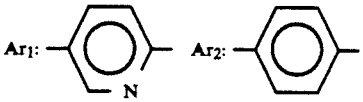
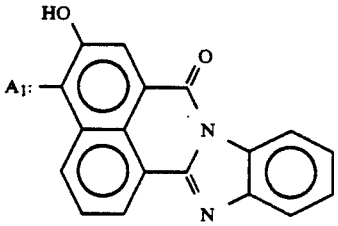
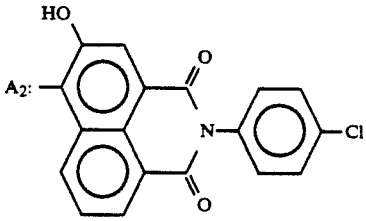
Exemplified pigment (8)
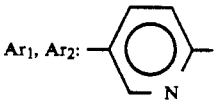
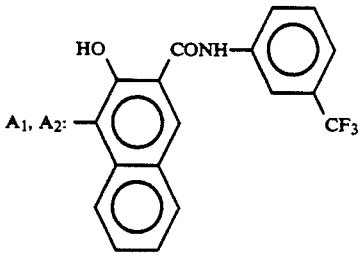
Exemplified pigment (9)
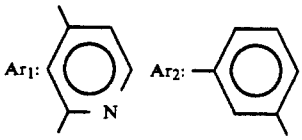

-continued
General formula (1)
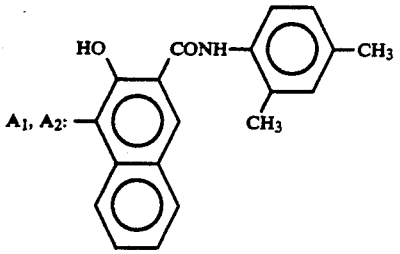
Exemplified pigment (10)
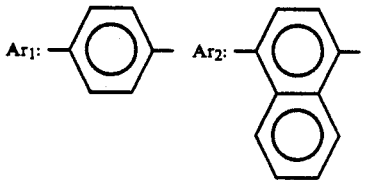
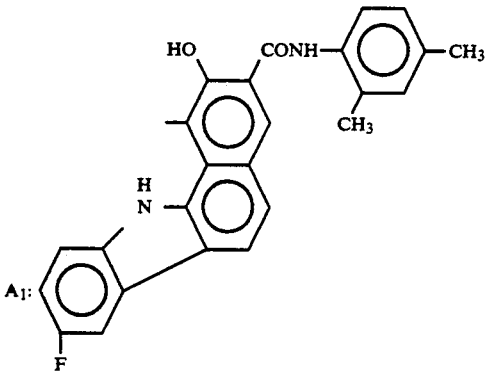
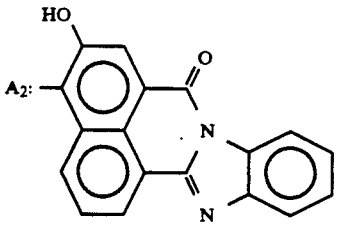
Exemplified pigment (11)
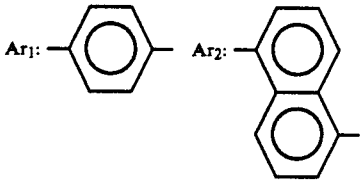
-continued
General formula (1)
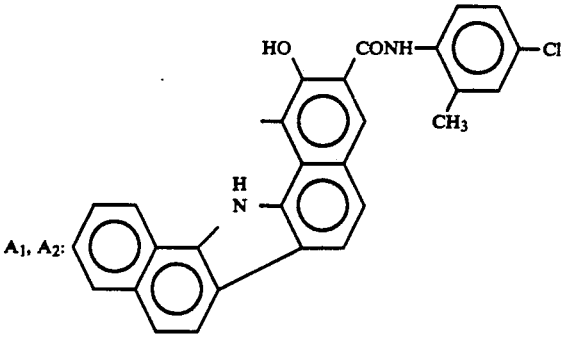
Exemplified pigment (12)
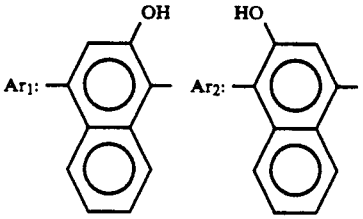
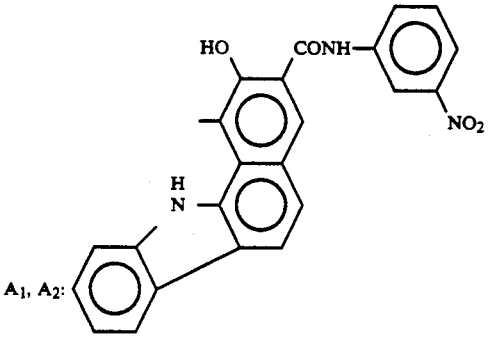
Exemplified pigment (13)
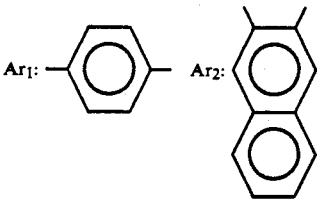
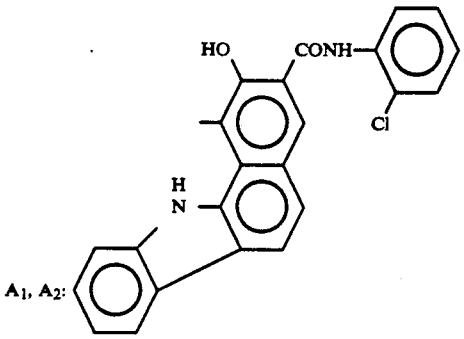
Exemplified pigment (14)

-continued
General formula (1)
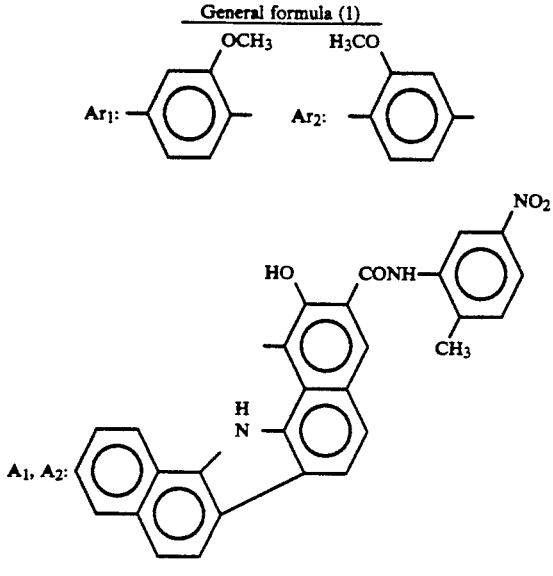
Exemplified pigment (15)
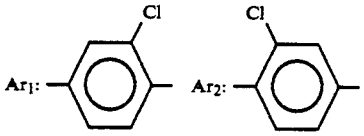
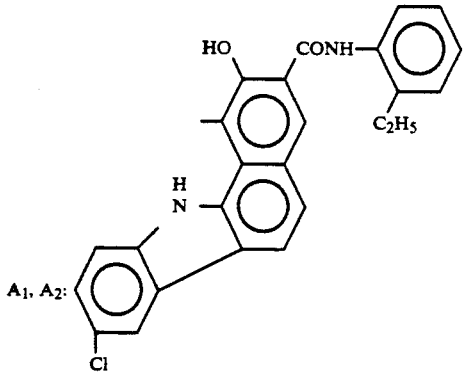
Exemplified pigment (16)
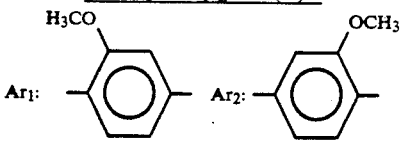
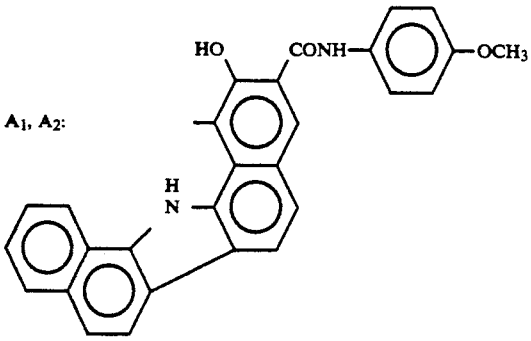
Exemplified pigment (17)
-continued
General formula (1)
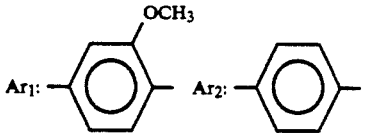
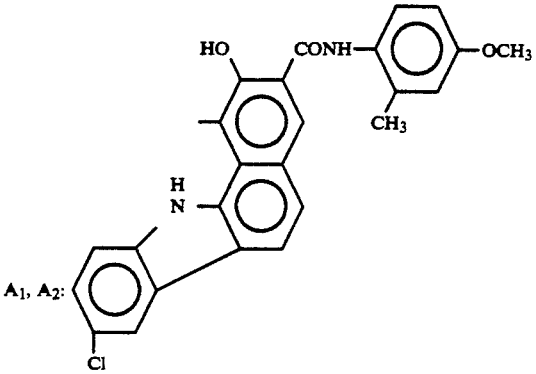
Exemplified pigment (18)
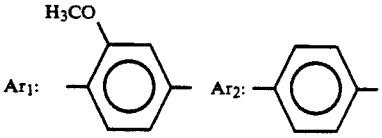
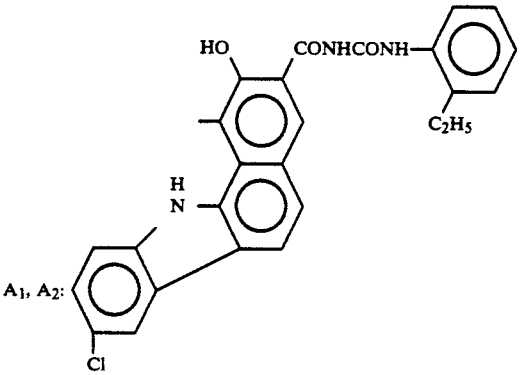
Exemplified pigment (19)
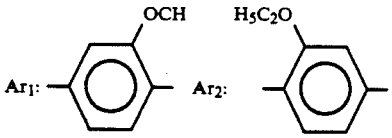
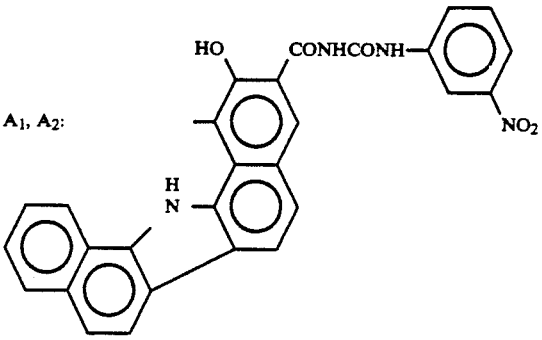
Exemplified pigment (20)

-continued
General formula (1)
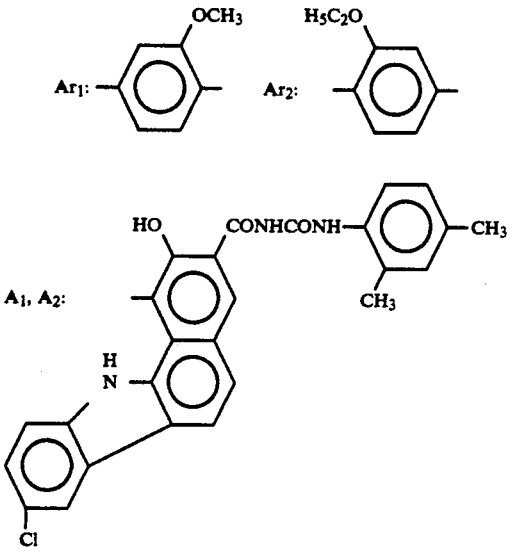
Exemplified pigment (21)
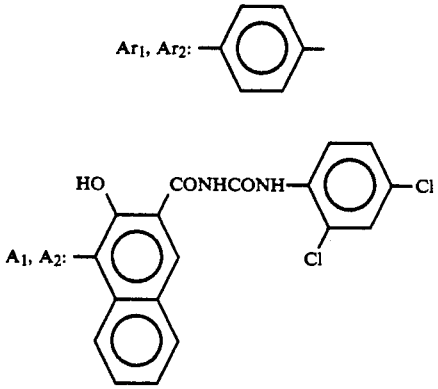
Exemplified pigment (22)
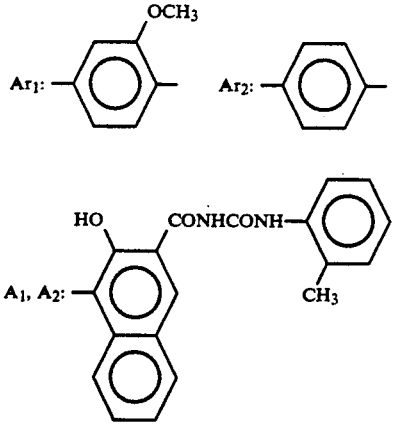
Exemplified pigment (23)
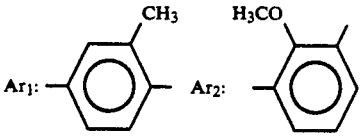
-continued
General formula (1)
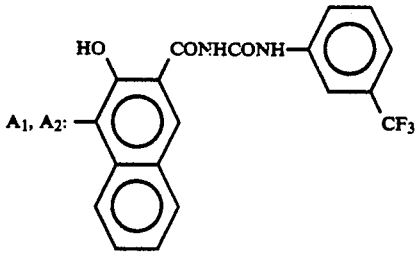
Exemplified pigment (24)
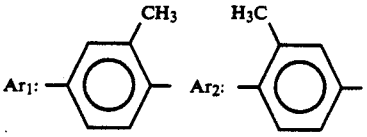
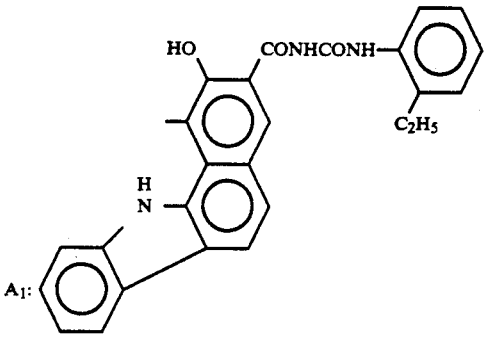
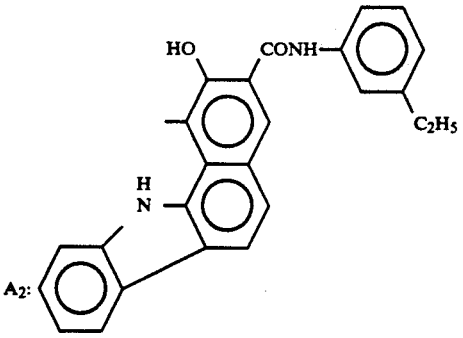
Exemplified pigment (25)
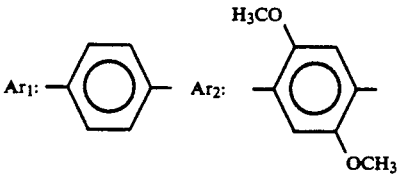

-continued
General formula (1)
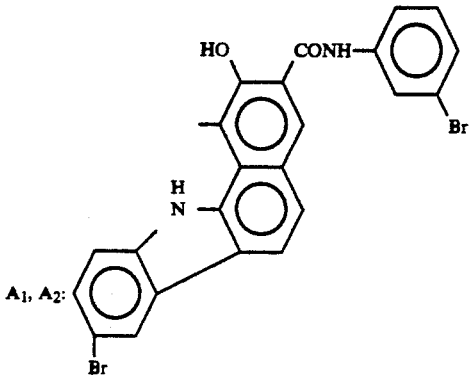
Exemplifed pigment (26)
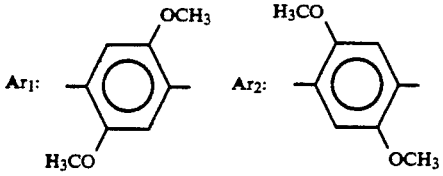
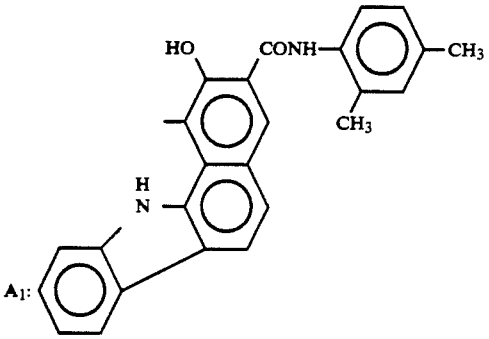
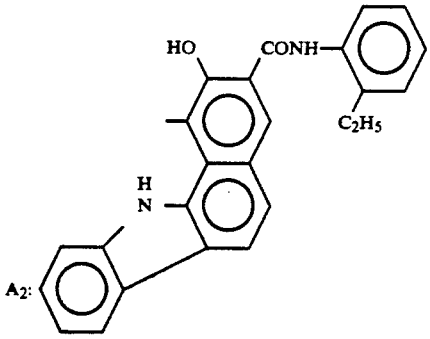
Exemplified pigment (27)
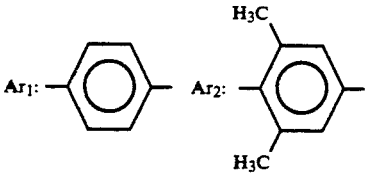
-continued
General formula (1)
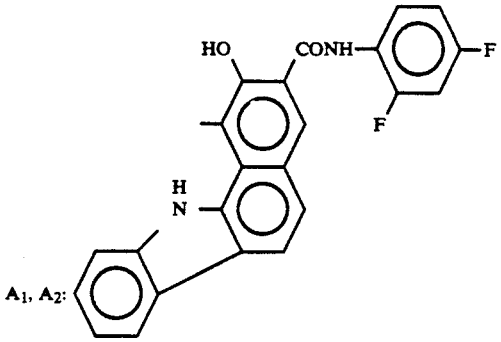
Exemplified pigment (28)
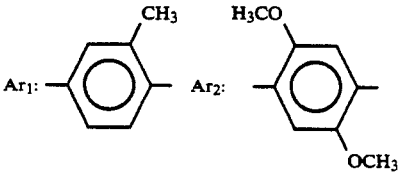
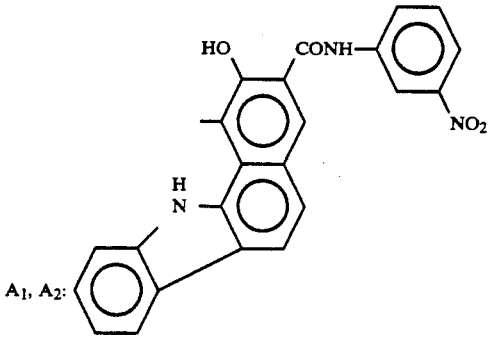
Exemplified pigment (29)
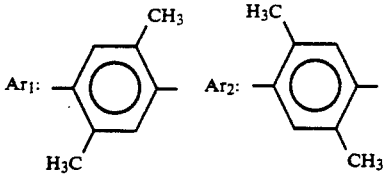
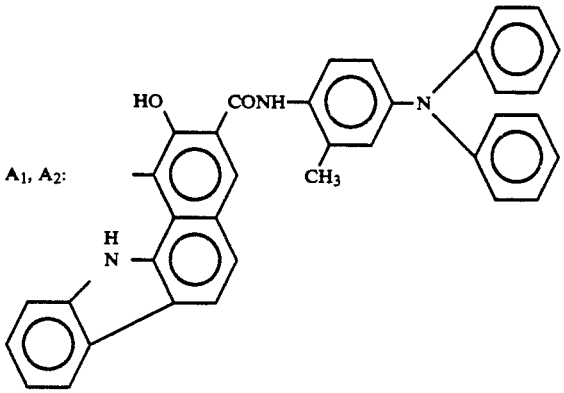
Exemplified pigment (30)

-continued

General formula (1)

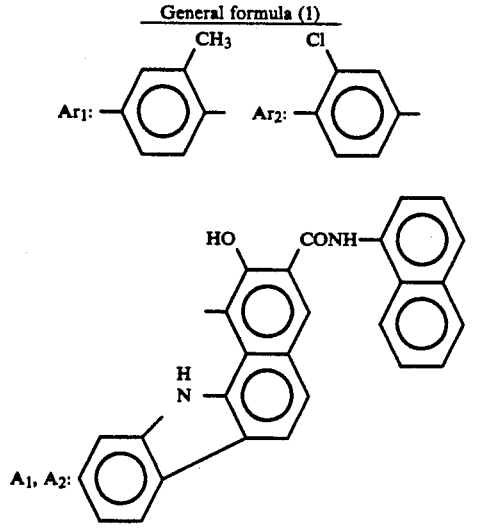

Exemplified pigment (31)

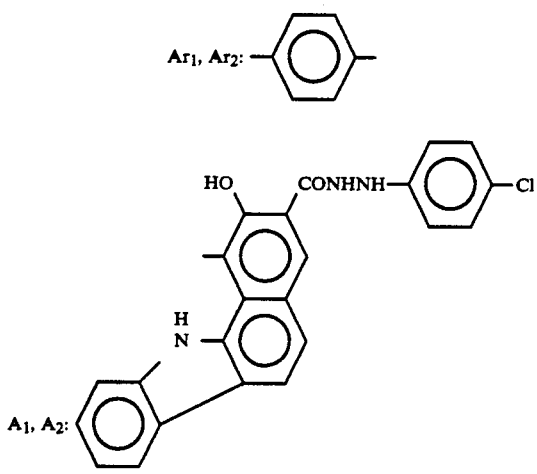

Exemplified pigment (32)

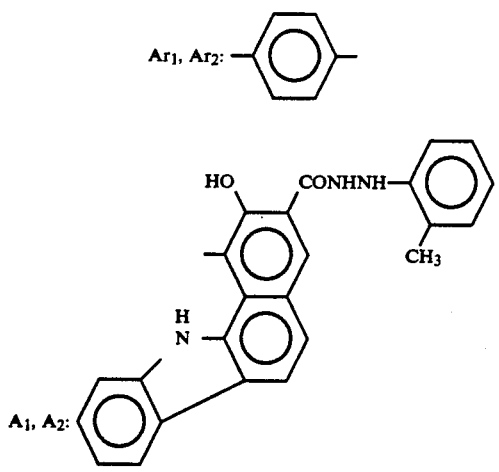

The azo pigment of the general formula (1) is readily synthesized by tetrazotizing a corresponding diamine in a conventional manner and coupling with a coupler in an aqueous solution in the presence of an alkali, or otherwise, isolating the aforementioned tetrazonium salt of the diamine as a fluoroborate or a zinc chloride double salt and coupling it with the aforementioned coupler in a suitable solvent such as N,N-dimethylformamide, dimethylsulfoxide, and the like in the presence of a base such as sodium acetate, triethylamine, N-methylmorpholine, and the like.

The synthesis of an azo pigment in which $A_1$ and $A_2$ are different from each other can be synthesized by coupling 1 mol of one type of coupler to 1 mol of the aforementioned tetrazolium salt, and then coupling 1 mol of another type of coupler, or otherwise protecting one amino group with an acetyl group or the like, diazotizing it, coupling one type of coupler with it, hydrolyzing the protected group with hydrochloric acid or the like, diazotizing it further, and coupling the other type of coupler with it.

Synthesis example (Synthesis of Exemplified pigment (1))

150 ml of water, 20 ml (0.23 mol) of concentrated hydrochloric acid, 7.3 g (0.032 mol) of 4,4-diaminoazoxybenzene were placed in a 300-ml beaker and cooled to 0° C. A solution of 4.6 g (0.067 mol) of sodium nitrite in 10 ml of water was added dropwise to the solution over 10 minutes at a reaction temperature of 5° C. or lower.

After stirring for 15 minutes, the reaction solution was filtered with carbon. An aqueous solution of 10.5 g (0.096 mol) of sodium borofluoride in 90 ml of water was dropwise added thereto with stirring. The sedimented borofluoride salt was collected by filtration, washed with cold water and then with acetonitrile, and dried under reduced pressure. The yield was 9.7 g (74%).

Separetely, 500 ml of N,N-dimethylformamide was placed in 1-liter beaker. Therein, 12.5 g (0.042 mol) of 2-hydroxy-3-(2'-chlorophenylcarbamoyl)naphthalene was dissolved, and the solution was cooled to a temperature of 5° C. 8.2 g (0.020 mol) of the borofluoride salt prepared above was dissolved, and subsequently, 5.1 g (0.050 mol) of triethylamine was added dropwise to the solution in 5 minutes. After stirring for 2 hours, the precipitated pigment was collected by filtration, washed four times with N,N-dimethylformamide, and three times with water, and was freeze-dried. The yield was 13.4 g (79%).

| Elemental analysis: | Calculated (%) | Observed (%) |
|---|---|---|
| C | 65.33 | 65.19 |
| H | 3.58 | 3.69 |
| N | 13.25 | 13.02 |

The electrophotographic photosensitive member of the present invention comprises a photosensitive layer containing an azo pigment represented by the general formula (1) provided on an electroconductive layer. The photosensitive layer may be in any of the conventional forms. A particularly preferable one is a function-separation type of photosensitive layer constituted of a lamination of a charge-generating layer containing an azo dye of the formula (1) and a charge-transporting layer containing a charge-transporting substance.

The charge-generating layer may be formed by applying a coating solution having the above azo pigment dissolved in a suitable solvent together with a binder resin onto an electroconductive support in a conventional manner. The thickness of the layer is desirably 5

μm or less, preferably in the range of from 0.1 to 1.3 μm.

The binder resin used therefor is selected from a variety of insulating resins and organic photoconductive polymers, preferably from polyvinylbutyral resins, polyvinylbenzal resins, polyarylate resins, polycarbonates, polyesters, phenoxy resins, cellulose resins, acrylic resins, polyurethanes, and the like. The amount used is not more than 80% by weight, preferably not more than 55% by weight in the charge-generating layer.

The solvent used therefor is selected from those which dissolve the above resin but do not dissolve a charge-transporting layer described below or a subbing layer. Specifically, the solvents include ethers such as tetrahydrofuran, 1,4-dioxane, and the like; ketones such as cyclohexanone, methyl ethyl ketone, and the like; amides such as N,N-dimethylformamide, and the like; esters, such as methyl acetate, ethyl acetate, and the like; aromatic solvents such as toluene, xylene, chlorobenzene, and the like; alcohols such as methanol, ethanol, 2-propanol, and the like; aliphatic halogenated hydrocarbons such as chloroform, methylene chloride, dichloroethylene, carbon tetrachloride, trichloroethylene, and the like, and so on.

The charge-transporting layer is laminated on the front of or behind a charge-generating layer, and has a function of receiving charge carriers from the charge generating-layer in an electric field and transporting the carriers.

The charge transporting-layer may be formed by applying a coating of a solution of a charge-transporting-substance in a suitable solvent optionally together with a binder resin. The thickness of the layer is generally in the range of from 5 to 40 μm, preferably from 15 to 30 μm.

The charge-transporting-substance includes electron-transporting substances and hole-transporting substances.

The electron-transporting substances are exemplified by electron-attracting substance such as 2,4,7-trinitrofluorenone, 2,4,5,7-tetranitrofluoreneone, chloranil, tetracyanoquinodimethane, and the like; and polymers of these electron-attracting substances.

The hole-transporting substances are exemplified by polycyclic aromatic compounds such as pyrene, anthracene, and the like; heterocyclic compounds such as carbazoles, indoles, imidazoles, oxazoles, thiazoles, oxadiazoles, pyrazoles, pyrazolines, thiadiazoles, traizoles, and the like; hydrazone type compounds such as p-diethylaminobenzaldehyde-N,N-diphenylhydrazone, N,N-diphenylhydrazino-3-methylidene-9-ethylcarbazole, and the like; styryl type compounds such as α-phenyl-4'-N,N-diphenylaminostilbene, 5-[4-(di-p-tolylamino)-benzylidene]-5H-dibenzo[a,d]cycloheptene, and the like; benzidine type compounds, triarylmethane type compounds, triphenylamines; polymers having a radical of the above compounds in the main chain or a side chain (e.g., polyvinyl-N-carbazole, polyvinylanthracene, etc.).

In addition to these, inorganic materials such as selenium, selenium-tellurium, amorphous silicon, cadmium sulfide, and the like may be used.

Two or more of the charge-transporting substances may be used in combination.

If the charge-transporting substance does not have an appropriate film-forming property, a suitable binder may be used. The binder includes specifically insulating resins such as acrylic resins, polyarylate resins, polyesters, polycarbonates, polystyrenes, acrylonitrile-styrene copolymers, polyacrylamides, polyamides, chlorinated rubbers, and the like; and organic photoconductive polymers such as poly-N-vinylcarbazoles, polyvinylanthracenes, and the like.

The electroconductive supports on which the photosensitive layer is formed may be made of aluminum, aluminum alloys, copper, zinc, stainless steel, titanium, nickel, indium, gold, platinum, and the like. Further, useful are plastics having a film of such a metal or an alloy vapor-deposited thereon such as polyethylene resins, polypropylene resins, polyvinyl chloride resins, polyethylene terephthalate resins, acrylic resins, and the like; supports made of plastics or metal substrates, coated on the surface with an electroconductive particulate material (e.g., carbon black, particulate silver, etc.); and a support made of plastics or paper having a particulate electroconductive material impregnated therein.

A subbing layer having a barrier function and adhesive function may be provided between the electroconductive support and the photosensitive layer. The subbing layer may be formed from casein, polyvinyl alcohols, nitrocellulose resins, polyamides (nylon 6, nylon 66, nylon 610, nylon copolymers, alkoxymethylated nylon, and the like), polyurethanes, aluminum oxide, or the like. The thickness of the subbing layer is generally 5 μm or less, preferably in the range of from 0.1 to 3 μm.

Another specific embodiment of the present invention is an electrophotographic photosensitive member containing the azo pigment and the charge-transporting substance which are contained in the same layer. Further, a charge-transfer complex composed of poly-N-vinylcarbazole and trinitrofluorenone may be used as the charge-transporting substance. This electrophotographic photosensitive member can be formed by applying a coating of a solution of the azo pigment and a charge transfer complex in a suitable solvent containing a resin dissolved therein.

The azo pigment employed in the present invention may either be crystalline or amorphous. The azo pigment may be a combination of two or more of the azo dyes represented by the general formula (1), or may be used in combination with a known charge-generating substance.

Further, in the present invention, a resin-containing layer, namely a protective layer may be provided on the photosensitive layer for the purpose of protecting the photosensitive layer against mechanical and chemical action from outside.

The electrophotographic photosensitive member of the present invention is useful not only for electrophotographic copying machines, but also for wide electrophotographic applications such as laser beam printers, CRT printers, LED printers, liquid crystal printers, laser engraving, and the like.

FIG. 1 shows a schematic diagram of a usual transfer type electrophotographic apparatus employing the electrophotographic photosensitive member of the present invention.

In FIG. 1, a drum type photosensitive member 1 serves as an image carrier, being driven to rotate around the axis 1a in the arrow direction at a predetermined peripheral speed. The photosensitive member 1 is charged positively or negatively at the peripheral face uniformly during the rotation by an electrostatic charging means 2, and then exposed to imagewise light projection L (e.g. slit exposure, laser beam-scanning exposure, etc.) at the exposure portion 3 with a image-projecting means (not shown in the figure), whereby electrostatic latent images are sequentially formed on the peripheral surface in accordance with the exposed image.

The electrostatic latent image is developed with a toner by a developing means 4, and the toner-developed images are sequentially transferred by a transfer means 5 onto a transfer material P which is fed between the photosensitive member and the transfer means 5 synchronously with the rotation of the photosensitive member 1 from a transfer material feeder not shown in the figure.

The transfer-receiving material P having received the transferred image is separated from the photosensitive member surface, and introduced to an image fixing means 8 for fixation of the image and discharged from the copying machine as a duplicate copy.

The surface of the photosensitive member 1, after the image transfer, is cleaned with a cleaning means 6 to remove any residual untransferred toner, and is treated with electrostatic charge eliminating means 7 to be served repetitively for image formation.

The generally and usually employed charging means 2 for uniformly charging the photosensitive member 1 are corona charges. The generally and usually employed transfer means 5 are also a corona charging means. In the electrophotographic apparatus, two or more of the constitutional elements of the above described photosensitive member, the developing means, the cleaning means, etc. may be integrated as one apparatus unit, which may be made demountable from the main body of the apparatus. For example, at least one of an electrostatic charging means, a developing means, and a cleaning means is combined with the photosensitive member into one unit demountable from the main body of the apparatus by aid of a guiding means such as a rail of the main body of the apparatus. A electrostatic charging means and/or a developing means may be combined with the aforementioned unit.

The optical image light projection L is practiced by reflected light or transmitted light from an original copy when the electrophotographic apparatus is used as a copying machine or a printer, or by signalizing a readout of a manuscript copy by reflected or transmitted light, scanning a laser beam according to the signal, and driving an LED array or a liquid crystal shutter array.

Figure 2:
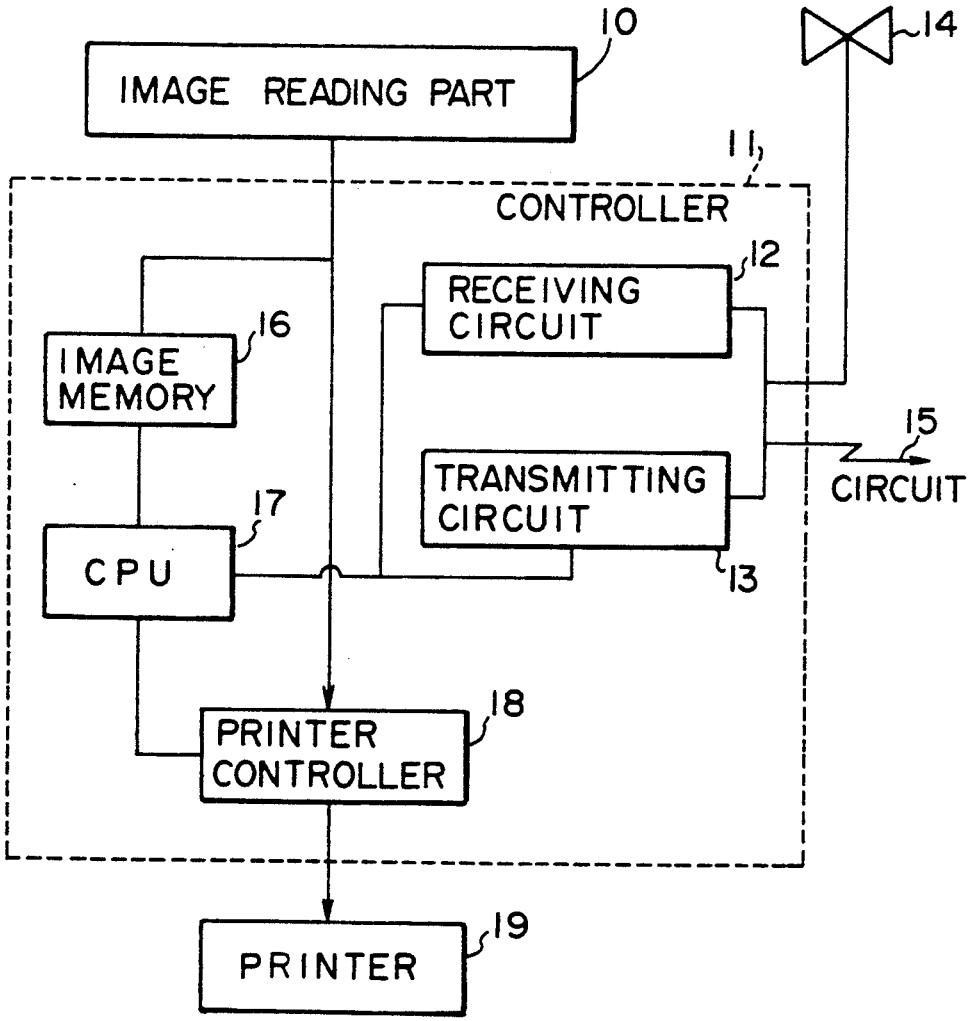
FIG. 2 is a block diagram of a facsimile apparatus provided with an electrophotographic device employing an electrophotographic photosensitive member of the present invention.

In use for a printer of a facsimile apparatus, the optical imagewise light projection L is the exposure for printing the received data. FIG. 2 is a block diagram of an example of this case.

A controller 11 controls an image reading part 10 and a printer 19. The whole of the controller 11 is controlled by a CPU 17. Readout data from the image reading part is transmitted through a transmission circuit 13 to the other communication station. Data received from the other communication station is transmitted through a receiving circuit 12 to a printer 19. The image data is stored in image memory. A printer controller 18 controls a printer 19. The numeral 14 denotes a telephone set.

The image received through circuit 15, namely image information from a remote terminal connected through a circuit, is demodulated by receiving circuit 12, treated for decoding of the image information in CPU 17, and successively stored in image memory 16. When at least one page of image is stored in the image memory 16, the image is recorded. The CPU 17 read out of memory 16 the one page of image information, and send out the decoded one page of information to the printer controller 18, which controls the printer 19 on receiving the one page of information from CPU 17 to record the image information.

Incidentally the CPU 17 receives the following page of information while recording is conducted by the printer 19.

Images are received and recorded in the manner as described above.

EXAMPLES 1-13

On an aluminum plate, a subbing layer having a dried thickness of 1 μm was provided by applying with a Meyer bar a solution of 5 g of a methoxymethylated nylon resin (number-average molecular weight: 32000) and 10 g of an alcohol-soluble nylon copolymer resin (number-average molecular weight: 29,000) in 95 g methanol.

Separately, 5 g of Exemplified pigment (1) shown above was added into a solution of 2 g of a butyral resin (butyralation degree: 63 mol %) in 95 ml of cyclohexanone, and the resulting mixture was dispersed with a sand mill for 10 hours. This dispersion was applied on the above formed subbing layer with a Meyer bar to form a charge-generating layer having a dried thickness of 0.3 μm.

5 g of the hydrazone compound represented by the formula below

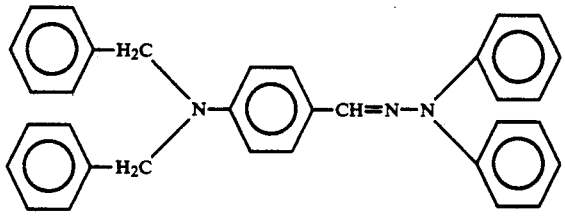

and 5 g of polymethyl methacrylate (number-average molecular weight: 100,000) were dissolved in 40 g of monochlorobenzene. This solution was applied on the charge-generating layer prepared above with a Meyer bar and dried to form a charge-transporting layer having thickness of 23 μm, thus providing a photosensitive member of Example 1.

The photosensitive members of Examples 2 to 13 were prepared in the same manner as Example 1 except that the Exemplified compounds shown below were used in place of Examplified compound (1).

The electrophotographic photosensitive members prepared thus were evaluated for charging characteristics with an electrostatic copying-paper tester (Model SP-428, made by Kawaguchi Denki K.K.) such that the photosensitive member was negatively charged by corona discharge of −5 KV, left standing for 1 second in the dark, and exposed to light of 10 lux by use of a halogen lamp.

As the charging characteristics measured were the surface potentials ($V_0$) and the amount of exposure ($E_{\frac{1}{2}}$) required for decreasing the surface potential by half after decay for one second in the dark.

The results are shown below.

| Example No. | Exemplified pigment | $V_0$ (−V) | $E_{\frac{1}{2}}$ (lux · sec) |
|---|---|---|---|
| 1 | (1) | 690 | 3.8 |
| 2 | (2) | 710 | 2.9 |
| 3 | (3) | 710 | 2.2 |
| 4 | (10) | 700 | 4.5 |
| 5 | (14) | 690 | 1.8 |
| 6 | (15) | 685 | 2.3 |
| 7 | (16) | 695 | 2.8 |
| 8 | (17) | 695 | 2.5 |
| 9 | (18) | 695 | 2.8 |
| 10 | (24) | 695 | 1.2 |
| 11 | (26) | 700 | 1.4 |
| 12 | (27) | 705 | 2.0 |
| 13 | (28) | 690 | 1.6 |

Comparative examples 1 and 2

Electrophotographic photosensitive members were prepared in the same manner as in Example 1 except that the azo pigments of the formulas below were used. The charging characteristics were measured in the same manner as in Example 1.

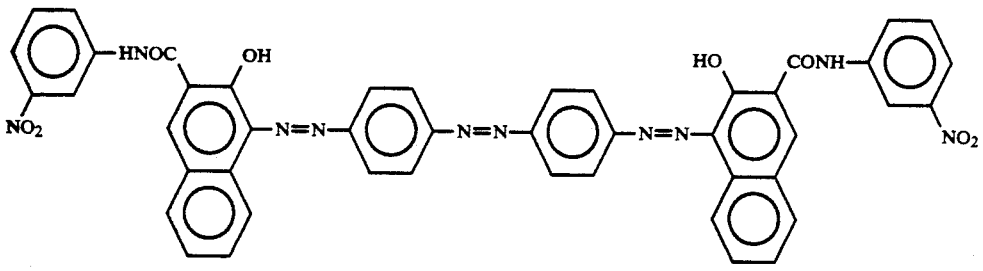

Comparative pigment (2) for Comparative example 2:

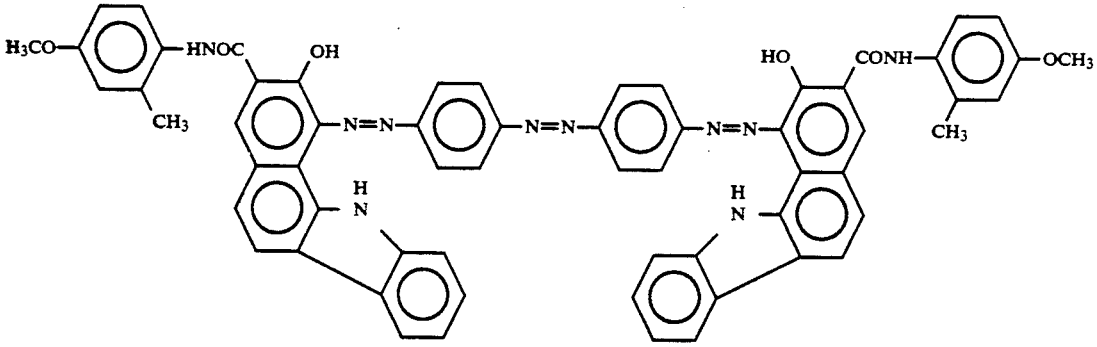

The results are shown below.

| Comparative example | Comparative pigment | $V_0$ (−V) | $E_{\frac{1}{2}}$ (lux · sec) |
|---|---|---|---|
| 1 | (1) | 670 | 6.5 |
| 2 | (2) | 660 | 5.8 |

From the result above, any of the electrophotographic photosensitive members of the present invention has sufficient charging characteristics and sufficient sensitivity.

EXAMPLES 14–18

The electrophotographic photosensitive member prepared in Example 1 was applied to a cylinder of an electrophotographic copying machine equipped with a −6.5 KV corona charger, an optical exposing system, an image developer, a transfer charger, a charge-eliminating optical exposing system, and a cleaner.

The dark potential ($V_D$) and the light potential ($V_L$) at the initial stage were set at around −700 V and −200 V, respectively. After the 5000 times of repetitive use, the variation of the dark potential ($\Delta V_D$) and the variation of the light potential ($V_L$) were measured.

The evaluation was conducted also for the photosensitive members prepared in Examples 2, 8, 10, and 11 in the same manner. The negative sign for the variation of potentials shows decrease of the absolute value of the potential, and the positive sign shows increase thereof.

The results are shown below.

| Example No. | Exemplified pigment | $\Delta V_D$ | $\Delta V_L$ |
|---|---|---|---|
| 14 | (1) | −10 | −5 |
| 15 | (2) | −10 | 0 |
| 16 | (17) | −5 | +5 |
| 17 | (24) | −10 | −5 |
| 18 | (26) | −10 | 0 |

Comparative examples 3 and 4

The electrophotographic photosensitive member prepared in Comparative examples 1 and 2 were used repeatedly, and the variation of the potentials were measured in the same manner as in Example 14. The results are shown below.

| Comparative example | $\Delta V_D$ | $\Delta V_L$ |
|---|---|---|
| 3 | −30 | +30 |
| 4 | −40 | +35 |

The results of Examples 14 to 18 and Comparative examples 3 and 4 shows that the electrophotographic photosensitive members of the present invention exhibit less variation of the potentials when used repeatedly.

EXAMPLE 19

A subbing layer of polyvinyl alcohol of 0.5 μm thick was formed on aluminum surface of an aluminum-vapor-deposited polyethylene terephthalate film. Thereon, the dispersion of the azo pigment used in Example 10 was applied with a Meyer bar and dried to form a charge-generation layer of 0.3 μm thick.

5 g of the styryl compound represented by the structural formula below

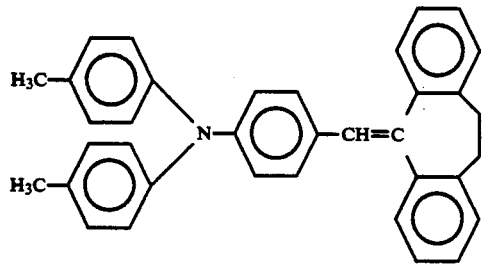

and 5 g of a polycarbonate (number-average molecular weight: 55,000) were dissolved in 40 g of tetrahydrofuran. This solution was applied on the charge-generating layer prepared above and dried to form a charge-transporting layer of 21 μm thick. The photosensitive member thus prepared was tested for charging characteristics and durability in the same manner as in Example 1 and Example 14. The results are shown below.

$V_O$: −700 V
$E_{\frac{1}{2}}$: 1.0 lux.sec
$\Delta V_D$: −5 V
$\Delta V_L$: 0 V

EXAMPLE 20

An electrophotographic photosensitive member was prepared by applying the charge-generating layer and the charge-transporting layer of Example 19 in the reverse order. The photosensitive member was evaluated for charging characteristics in the same manner as in Example 1 except that the charging was positive.

The results are shown below.

$V_O$: +690 V
$E_{\frac{1}{2}}$: 3.9 lux.sec

EXAMPLE 21

On the charge-generating layer prepared in Example 1, a coating solution prepared by dissolving 5 g of 2,4,7-trinitro-9-fluorenone and 5 g of poly-4,4'-dioxydiphenyl-2,2-propane carbonate (molecular weight: 300,000) in 50 g of tetrahydrofuran was applied with a Meyer bar and dried to form a charge-transporting layer of 18 μm thick.

The electrophotographic photosensitive member thus prepared was evaluated for charging characteristics in the same manner as in Example 1 except that the charging was made positive. The results are as below.

$V_O$: +680 V
$E_{\frac{1}{2}}$: 5.3 lux.sec

EXAMPLE 22

0.5 g of Exemplified compound (1) was shaken with 9.5 g of cyclohexanone by means of a paint shaker for 5 hours to disperse the pigment. To this, a solution of 5 g of the charge-transporting substance used in Example 1 and 5 g of a polycarbonate resin in 40 g of tetrahydrofuran was added, and the mixture was shaken for further one hour. The coating liquid thus prepared was applied on an aluminum support plate by means of a Meyer bar coating and dried to form a photosensitive layer of 19 μm thick.

The electrophotographic photosensitive member prepared thus was evaluated for charging characteristics in the same manner as in Example 1 except that the charging was made positive. The results are as below.

$V_O$: +680 V
$E_{\frac{1}{2}}$: 4.8 lux.sec

What is claimed is:

1. An electrophotographic photosensitive member having a photosensitive layer provided on an electroconductive support, said photosensitive layer containing an azo pigment represented by the general formula (I):

$$A_1-N{=}N-Ar_1-\overset{\overset{\displaystyle O}{\uparrow}}{N}{=}N-Ar_2-N{=}N-A_2 \qquad (1)$$

wherein $Ar_1$ and $Ar_2$ are respectively a divalent aromatic hydrocarbon group or a divalent heterocyclic group which may be the same or different and may have a substituent, and $A_1$ and $A_2$ are respectively a coupler residue having a phenolic hydroxyl group which may be the same or different.

2. The electrophotographic photosensitive member of claim 1, wherein the photosensitive layer comprises a charge-generating layer containing the azo pigment represented by the general formula (1), and a charge-transporting layer containing a charge-transporting substance.

3. The electrophotographic photosensitive member of claim 2, wherein the charge-transporting layer is provided on the front face of the charge-generating layer.

4. The electrophotographic photosensitive member of claim 2, wherein the charge-generating layer is provided on the front face of the charge-transporting layer.

5. The electrophotographic photosensitive member of claim 1, wherein the photosensitive layer comprises a layer containing both of the azo pigment of the general formula (1) and a charge-transporting substance.

6. The electrophotographic photosensitive member of claim 1, wherein a subbing layer is interposed between the electroconductive support and the photosensitive layer.

7. The electrophotographic photosensitive member of claim 1, wherein a protective layer is provided of the photosensitive layer.

8. The electrophotographic photosensitive member according to claim 1, wherein said $A_1$ and $A_2$ are each a coupler residue selected from the group consisting of the groups represented by the following formulae (2) to (6):

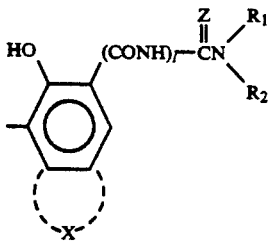

(2)

wherein X is a residue forming a polycyclic aromatic ring or a heterocyclic ring with the benzene ring in the formula; Z is an oxygen atom or a sulfur atom; and $R_1$ and $R_2$ are the same or different and are each selected from the group consisting of: a hydrogen atom, a substituted or unsubstituted alkyl group, a substituted or unsubstituted aryl group, a substituted or unsubstituted aralkyl group, a substituted or unsubstituted heterocyclic group and $R_1$ and $R_2$ together are bonded to form a cyclic amino group with a nitrogen atom in the formula, and l is either 0 or 1;

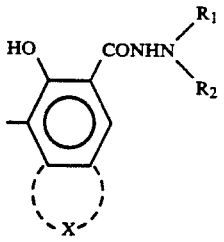

(3)

wherein X, $R_1$ and $R_2$ are the same as in formula (2);

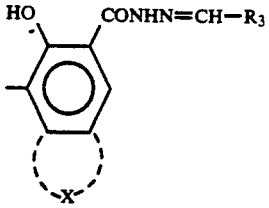

(4)

wherein X is the same as above, and $R_3$ is selected from the group consisting of a hydrogen atom, a substituted or unsubstituted alkyl group, a substituted or unsubstituted aryl group, a substituted or unsubstituted aralkyl group or a substituted or unsubstituted heterocyclic group;

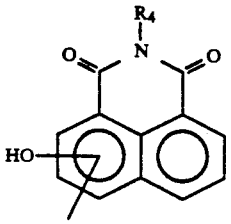

(5)

wherein $R_4$ is selected from the group consisting of a substituted or unsubstituted alkyl group, a substituted or unsubstituted aryl group, a substituted or unsubstituted aralkyl group or a substituted or unsubstituted heterocyclic group; and

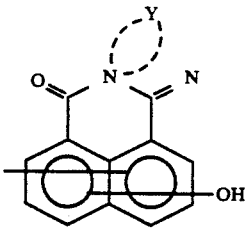

(6)

wherein Y is a substituted or unsubstituted bivalent aromatic hydrocarbon group or substituted or unsubstituted bivalent heterocyclic group having a nitrogen atom in its ring.

9. An electrophotographic photosensitive member according to claim 1, wherein said $A_1$ and $A_2$ are each selected form the formulae (2), (3) and (4), and said X is a residue forming a benzocarbazole with the benzene ring in the formula.

* * * * *

UNITED STATES PATENT AND TRADEMARK OFFICE

CERTIFICATE OF CORRECTION

PATENT NO. : 5,272,028

DATED : December 21, 1993

INVENTOR(S) : YOSHIO KASHIZAKI, ET AL.

It is certified that error appears in the above-identified patent and that said Letters Patent is hereby corrected as shown below:

COLUMN 2

Line 57, "mula" should read --mulas--.

COLUMN 3

Formula 6, " 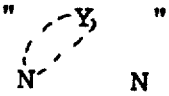 " should read -- 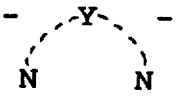 --

Line 50, "o-naphtylene, perinaphthylene," should read --o-naphthylene, peri-naphthylene--.
Line 52, "6,7-quinolinedily," should read --6,7-quinolinediyl,--.
Line 54, "formula (2)," should read --formulas (2),--.
Line 67, "naphtyl," should read --naphthyl,--.

COLUMN 16

Line 34, "Separetely," should read --Separately,--.

COLUMN 17

Line 41, "2,4,5,7-tetranitrofluoreneone," should read --2,4,5,7-tetranitrofluorenone,--.
Line 48, "traizoles," should read --triazoles,--.

COLUMN 19

Line 27, "a" should be deleted.
Line 68, "read" should read --reads--.

UNITED STATES PATENT AND TRADEMARK OFFICE

CERTIFICATE OF CORRECTION

PATENT NO. : 5,272,028

DATED : December 21, 1993

INVENTOR(S) : YOSHIO KASHIZAKI, ET AL.

It is certified that error appears in the above-identified patent and that said Letters Patent is hereby corrected as shown below:

COLUMN 20

Line 1, "send" should read --sends--.
Line 17, "32000)" should read --32,000)--.
Line 54, "Examplified" should read --Exemplified--.

COLUMN 24

Line 60, "of" (second occurrence) should read --on--.

COLUMN 26

Line 35, "Y N" should read --Y N--
Line 49, "claim 1," should read --claim 8,--.
Line 50, "form" should read --from--.

Signed and Sealed this

Twenty-seventh Day of September, 1994

*Attest:*

*Attesting Officer*

Bruce Lehman

BRUCE LEHMAN

*Commissioner of Patents and Trademarks*